US008171710B2

(12) United States Patent
Coan

(10) Patent No.: US 8,171,710 B2
(45) Date of Patent: May 8, 2012

(54) AUTOMATIC LACER FOR BUNDLES OF POLYMERIC FIBER

(75) Inventor: Frederick L. Coan, Antioch, CA (US)

(73) Assignee: Generon IGS, Inc., Houston, TX (US)

( * ) Notice: Subject to any disclaimer, the term of this patent is extended or adjusted under 35 U.S.C. 154(b) by 253 days.

(21) Appl. No.: 12/625,770

(22) Filed: Nov. 25, 2009

(65) Prior Publication Data

US 2010/0132537 A1 Jun. 3, 2010

Related U.S. Application Data

(60) Provisional application No. 61/119,428, filed on Dec. 3, 2008.

(51) Int. Cl.
*D02G 3/00* (2006.01)

(52) U.S. Cl. ..... 57/6

(58) Field of Classification Search ..... 57/3, 6, 57/10, 13, 15, 16, 17, 18
See application file for complete search history.

(56) References Cited

U.S. PATENT DOCUMENTS

| | | | | | |
|---|---|---|---|---|---|
| 3,282,037 | A * | 11/1966 | Barnett et al. | 57/18 |
| 3,382,655 | A * | 5/1968 | Wasserman | 57/16 |
| 3,508,389 | A * | 4/1970 | Remy | 57/16 |
| 4,290,260 | A * | 9/1981 | Wasserman | 57/210 |
| 4,869,059 | A * | 9/1989 | Austin | 57/210 |
| 4,998,403 | A * | 3/1991 | Bailey | 57/18 |
| 5,487,941 | A * | 1/1996 | Pepin | 428/364 |
| 5,598,874 | A | 2/1997 | Alei | |
| 5,901,544 | A * | 5/1999 | McNeill | 57/341 |
| 6,490,852 | B1 * | 12/2002 | Mustacich et al. | 57/3 |
| 6,869,493 | B2 * | 3/2005 | Tsai | 156/148 |
| 2008/0083209 | A1 * | 4/2008 | Saito et al. | 57/3 |

* cited by examiner

*Primary Examiner* — Shaun R Hurley
(74) *Attorney, Agent, or Firm* — William H. Eilberg

(57) ABSTRACT

An automatic lacer wraps bundles of polymeric fibers with thread, before the bundles are woven into a fabric mat and placed in a housing to form a gas-separation membrane module. A fiber bundle passes through a spool which is previously wound with thread on its outer surface. The thread is attached to the fiber bundle, so that when the bundle is moved through the spool, the thread is pulled from the spool, and automatically becomes wound around the bundle. Threads from two or more spools may be wrapped around the fiber bundle simultaneously. Lacing of the fiber bundles reduces the amount of tangling in the loom feeder, and improves the quality of modules made from the fiber bundles.

16 Claims, 5 Drawing Sheets

AUTOMATIC LACER FOR BUNDLES OF POLYMERIC FIBER

CROSS-REFERENCE TO PRIOR APPLICATION

Priority is claimed from U.S. Provisional Patent Application Ser. No. 61/119,428, filed Dec. 3, 2008, the entire disclosure of which is incorporated by reference herein.

BACKGROUND OF THE INVENTION

The present invention relates to the manufacture of modules containing a plurality of polymeric hollow fibers, for use in gas separation, air dehydration, or for other purposes. Specifically, the present invention provides a method and apparatus for automatically lacing bundles of such fibers, while the fibers are transported through equipment for manufacturing the modules.

It has been known to use a polymeric membrane to separate air into components. Various polymers have the property that they allow different gases to flow through, or permeate, the membrane, at different rates. A polymer used in air separation, for example, will pass oxygen and nitrogen at different rates. The gas that preferentially flows through the membrane wall is called the "permeate" gas, and the gas that tends not to flow through the membrane is called the "non-permeate" gas. The selectivity of the membrane is a measure of the degree to which the membrane allows one component, but not the other, to pass through.

A membrane-based gas separation system has the inherent advantage that the system does not require the transportation, storage, and handling of cryogenic liquids. Also, a membrane system requires relatively little energy. The membrane itself has no moving parts; the only moving part in the overall membrane system is usually the compressor which provides the gas to be fed to the membrane.

A gas separation membrane unit is typically provided in the form of a module containing a large number of small, hollow fibers made of the selected polymeric membrane material. The module is generally cylindrical, and terminates in a pair of tubesheets which anchor the hollow fibers. The tubesheets are impervious to gas. The fibers are mounted so as to extend through the tubesheets, so that gas flowing through the interior of the fibers (known in the art as the bore side) can effectively bypass the tubesheets. But gas flowing in the region external to the fibers (known as the shell side) cannot pass through the tubesheets.

In operation, a gas is introduced into a membrane module, the gas being directed to flow through the bore side of the fibers. One component of the gas permeates through the fiber walls, and emerges on the shell side of the fibers, while the other, non-permeate, component tends to flow straight through the bores of the fibers. The non-permeate component comprises a product stream that emerges from the bore sides of the fibers at the outlet end of the module.

One method for processing the fibers is described in U.S. Pat. No. 5,598,874, the disclosure of which is incorporated by reference herein. In the cited patent, the fibers are woven into a web, using a loom. After drying, the web is gathered into a rolled fabric mat which becomes the essential component of the module.

A serious problem with the above-described process is the tendency of the fibers to splay out while being automatically fed to the loom, and/or while being formed into a module. This splaying causes the fibers to become tangled, resulting in a ragged product. In some cases, the tangling can clog the feeder, and can require that the loom be stopped. Such stoppages obviously increase the overall cost of forming the fibers into modules. Also, it has been found that fiber modules having an excessive proportion of ragged fibers perform relatively poorly.

The present invention provides an automated system for reducing or eliminating the splaying of fibers, during the manufacture of a fiber membrane module. The invention not only reduces the effective cost of producing a module, but it also results in modules having improved selectivity.

SUMMARY OF THE INVENTION

A bundle of fibers is transported towards equipment for forming modules used for gas separation or for other purposes. The fiber bundle, or "tow", is made to pass through one or more hollow spools, around which a supply of thread has been wound. As the fiber bundle is transported through the system, and passes through the hollow center of the spool, the thread is unwound from the spool, and is automatically wound around the fiber bundle. The winding of the thread around the fiber bundle is caused, at least in part, by connecting the thread to the fiber bundle, and by pulling the fiber bundle through the system. Thus, the thread is automatically pulled away from the spool, and wound around the fiber bundle, as the fiber bundle is pulled through the system.

The wound fiber bundle is less susceptible to splaying of fibers, thereby reducing clogging and potential stoppages of the downstream equipment. The lacing of the fiber bundle also prevents damage to the fiber, and results in a module having improved gas-separation or other qualities. Thus, the present invention improves both the efficiency of production of hollow fiber membrane modules, and the quality of the modules so produced.

The present invention has the primary object of providing a method and apparatus for improving the efficiency of a manufacturing process for fiber membrane modules used for gas separation or for other purposes.

The invention has the further object of reducing the cost of making fiber membrane modules.

The invention has the further object of enhancing the quality of fiber membrane modules.

The invention has the further object of improving the selectivity of gas-separation membrane modules.

The invention has the further object of reducing stoppages of equipment used to make fiber membrane modules, and thereby to improve the productivity of such equipment.

The reader skilled in the art will recognize other objects and advantages of the present invention, from a reading of the following brief description of the drawings, the detailed description of the invention, and the appended claims.

DETAILED DESCRIPTION OF THE INVENTION

The present invention comprises a method and apparatus for automatically winding a thread around a bundle of fibers, so as to prevent the fibers from splaying out while the bundle is transported through equipment for making fiber modules.

Figure 1:
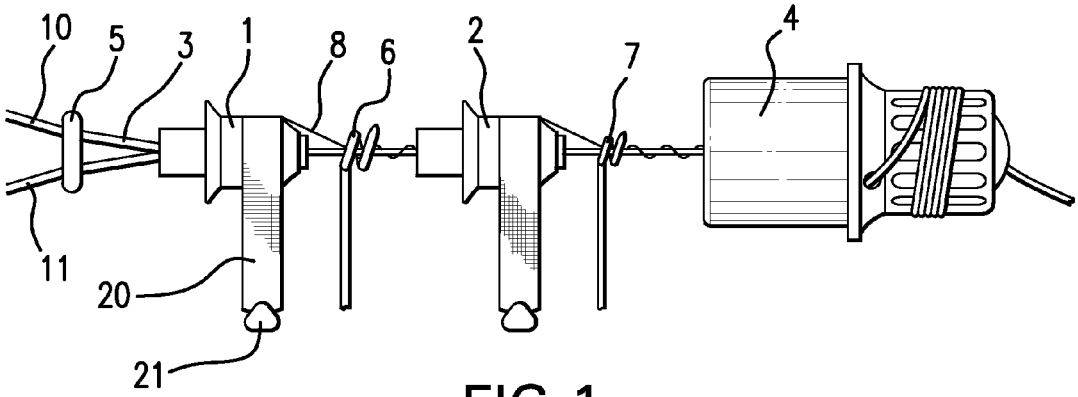
FIG. 1 provides a diagram showing the apparatus of the invention, wherein two spools carry thread which is automatically wrapped around a fiber bundle.

FIG. 1 shows two spools 1 and 2, the spools being pre-wound with thread 8. There can be more than two spools, or as few as a single spool. The spools have hollow central portions, allowing one or more fiber bundles, such as bundle 3, to pass through. The spools are held by holders 40 and/or other scaffolding, as shown in FIGS. 4 and 5.

As noted above, the spools are wound with a thread 8 which is used to lace fiber bundles. The spools are positioned between a feed device (not shown) for the fibers, and a fiber feeder 4, which pulls the fiber bundle through the system, and which supplies the laced fiber bundles to a loom (shown only in FIGS. 6-7). The fiber feeder 4 therefore comprises means for moving the fiber bundles through the hollow spools. Other means of moving the fiber bundles could be provided.

Figure 4:
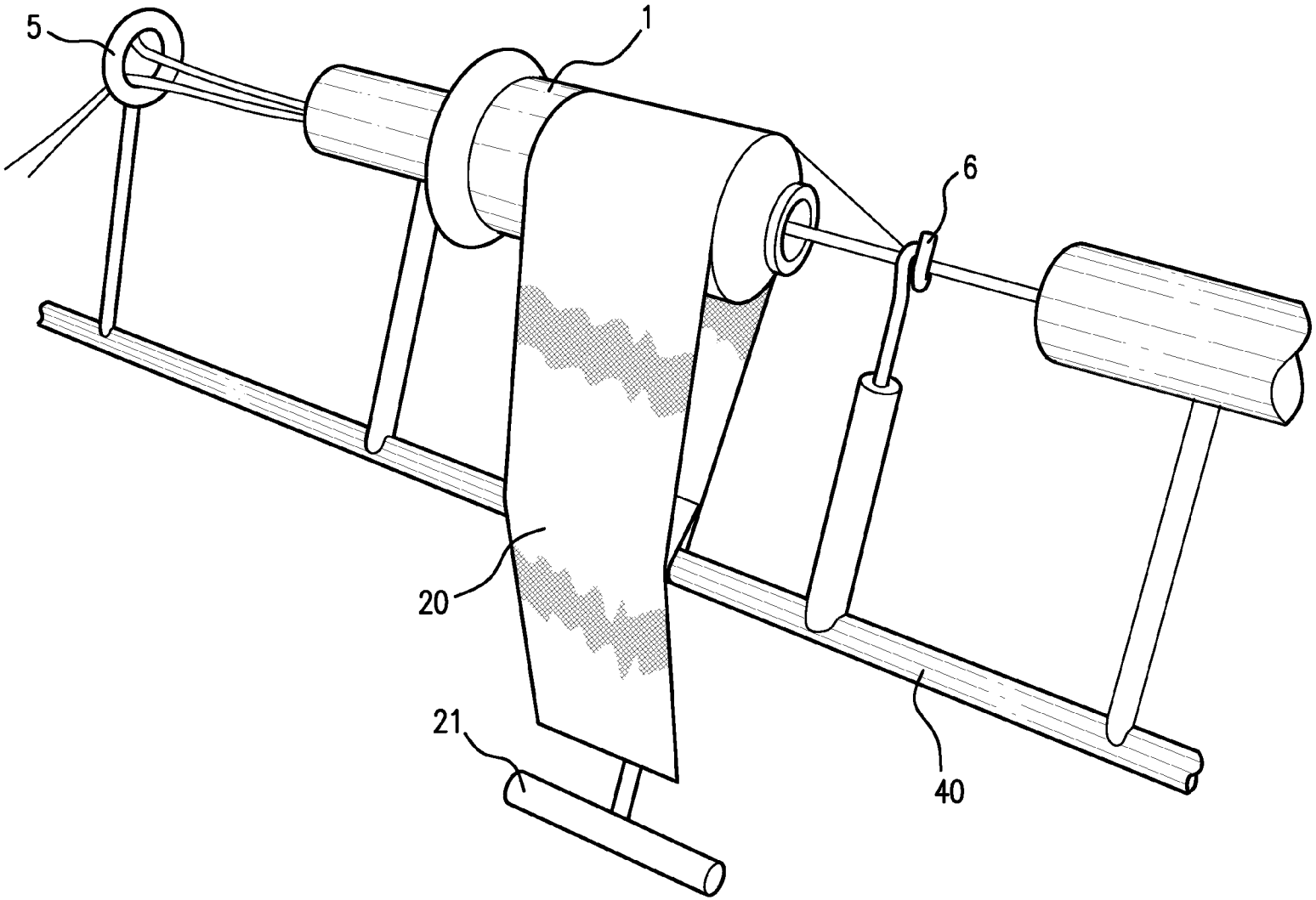
FIG. 4 provides a perspective view of the apparatus of the present invention, the figure showing one complete spool.
Figure 5:
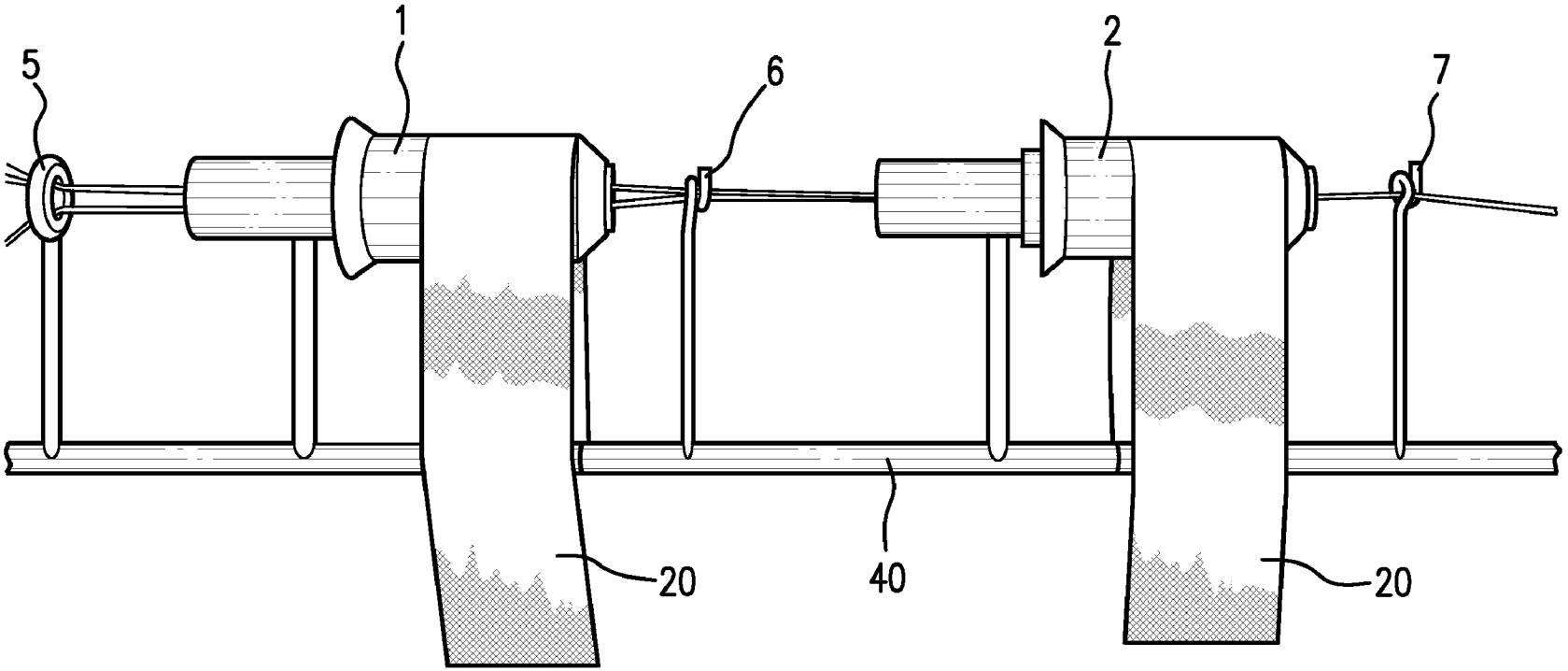
FIG. 5 provides a side elevational view of the apparatus of the present invention, the figure showing two spools.

A relatively large fiber eyelet 5, shown in FIG. 1 and also visible in FIGS. 4 and 5, is positioned upstream of spool 1. The large eyelet helps to guide the fiber bundles into the interior of spool 1. Smaller eyelets 6 and 7 are positioned about one or two inches downstream of each spool. These eyelets are shown in FIG. 1, as well as in FIGS. 4 and 5.

The bundles of fibers are known as "tow" bundles, the latter term being borrowed from the field of textile processing. The bundle of fibers is often called a "tow". A tow is analogous to a strand of untwisted yarn.

In the embodiment shown, two fiber bundles 10, 11 are processed at once. These two hollow fiber tow bundles, illustrated in FIGS. 1-3, and also visible in FIGS. 4 and 5, are threaded through the large inlet eyelet 5, then through spool 1, then through the first small eyelet 6, then through spool 2, and then through the second small eyelet 7. Then, the fiber bundles pass into the fiber feeder 4 for the loom. The invention can be used with more than two hollow fiber tow bundles. For example, instead of having two bundles, three or more bundles could be fed through the apparatus.

Before the fiber bundles begin to move through the system, the thread from each of the spools is initially tied, or otherwise attached, to the fiber bundles at a selected point on the fiber bundle, preferably near the forward end of the bundle. Then, as the bundles are moved through the system, i.e. from left to right in the drawings, the bundles pull on the threads. Because the threads are wound around the outer surfaces of the spools, pulling on the threads causes the threads to come off the spools in a circular pattern, causing the threads to become spirally wound around the fiber bundles. Thus, as the thread comes off the spool, the thread rotates around the fiber bundles, lacing the bundles together.

The thread becomes wrapped around the outside of the fiber bundle because the fiber bundle passes through the hollow center of the spool, while the thread is unwrapped from the outer portion of the spool. The outer wrapping of thread helps to hold the fiber bundle together as the bundle progresses through the downstream equipment. The process of winding the thread around the fiber bundle is illustrated particularly in FIG. 3.

Figure 2:
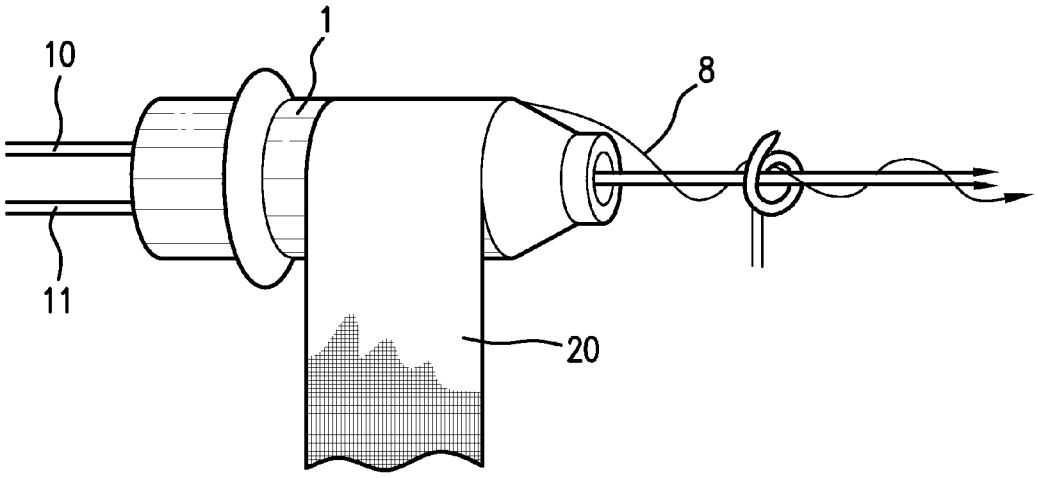
FIG. 2 provides a diagram showing one of the spools of FIG. 1, at a time when the thread begins to be unwound from the spool and wrapped around the fiber bundle.

Tensioning overwraps, such as overwrap 20, are preferably attached to the spools, especially spool 1. The tensioning overwrap 20 is simply a cloth attached to a weight 21, as illustrated in FIGS. 1 and 2, and also shown in FIGS. 4 and 5. The tensioning overwrap provides friction for the thread 8 as it unwinds from the spool 1, and causes the thread to be wound more tightly around the hollow fiber bundle. The amount of tensioning is adjusted to minimize hollow fiber bundle separation without adversely impacting membrane transport properties.

Both spools 1 and 2 operate in exactly the same way. Two spools are used to provide more windings of thread around the fiber bundles, at the same time. That is, the use of two spools effectively increases the number and density of windings of thread around the fiber bundles. More than two spools could be used, if desired, to increase further the number of windings of thread per unit length of the fiber bundles.

Another way to increase the density of threads wound around the fiber bundle is to drive the spools positively. That is, one or both spools could be rotated, in a direction opposite to the direction of rotation induced by the unwinding thread, so as to cause more thread to unwind from the spool in a given time. This alternative is not illustrated in the drawings.

Figure 3:
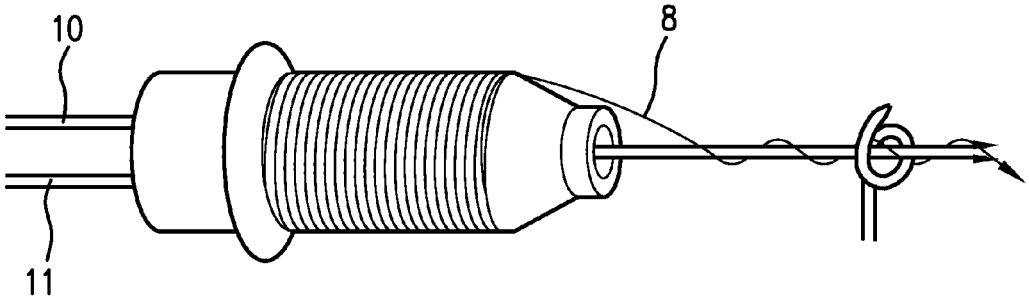
FIG. 3 provides a diagram showing one of the spools of FIG. 1, at a somewhat later time.

FIGS. 2 and 3 illustrate one of the spools, namely spool 1, at two different times. FIG. 2 represents the time at which the unwinding of thread 8 from the spool 1 has just begun. FIG. 3 represents a time at which the unwinding of thread 8 is already in progress. For convenience of illustration, the overwrap 20 is not shown in FIG. 3. FIGS. 2 and 3 clearly show how the thread will define a circular pattern as it comes off of the spool, and how it forms a spiral winding around the fiber bundles.

In one example, it was found that the best performance was obtained with spool 1 tensioned with a weight, and spool 2 having an overwrap which was left essentially unweighted.

Figure 6:
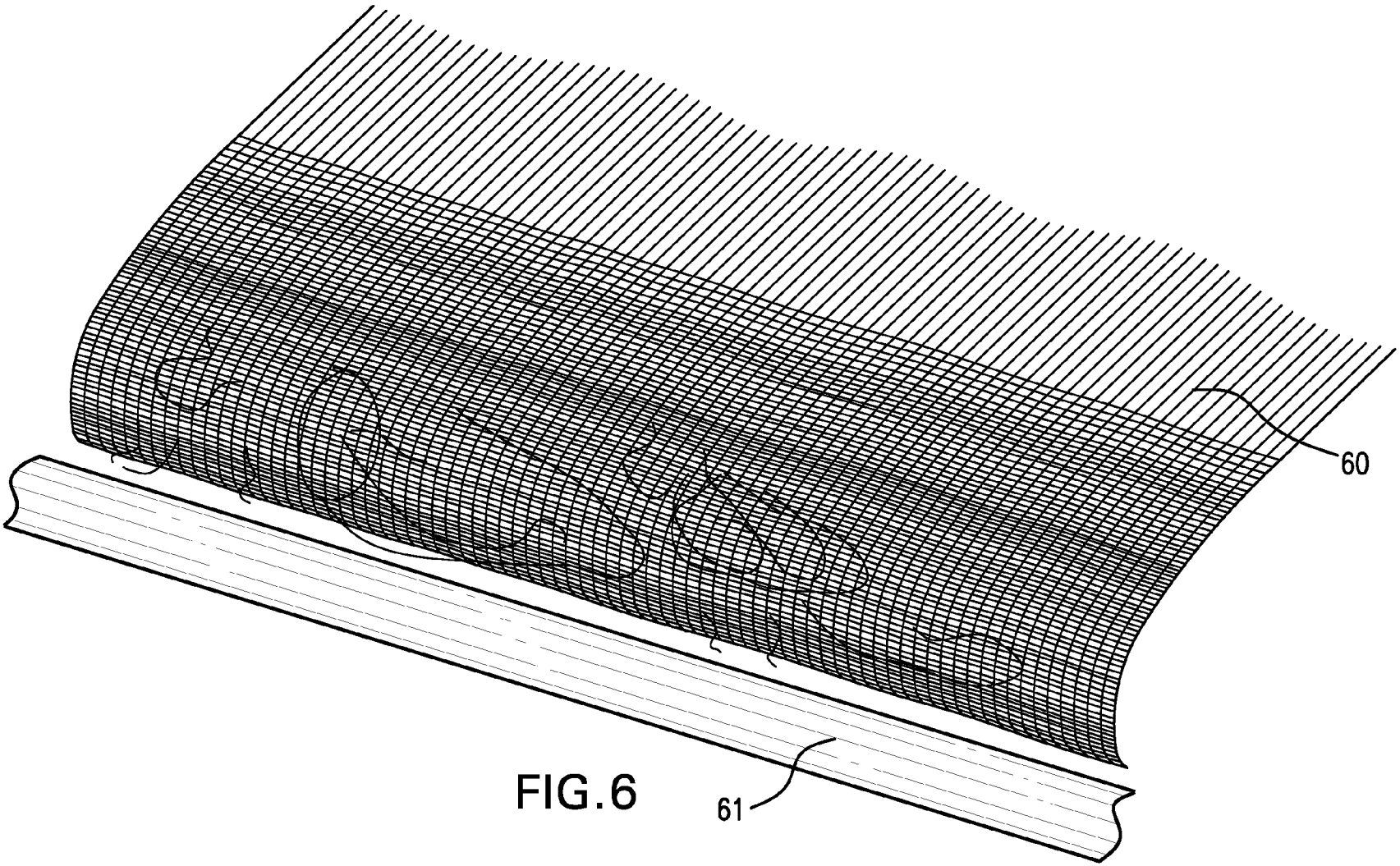
FIG. 6 provides a fragmentary perspective view showing a fabric mat, formed of fibers woven on a loom, wherein the fibers have been formed in bundles which have been laced with thread using the present invention.
Figure 7:
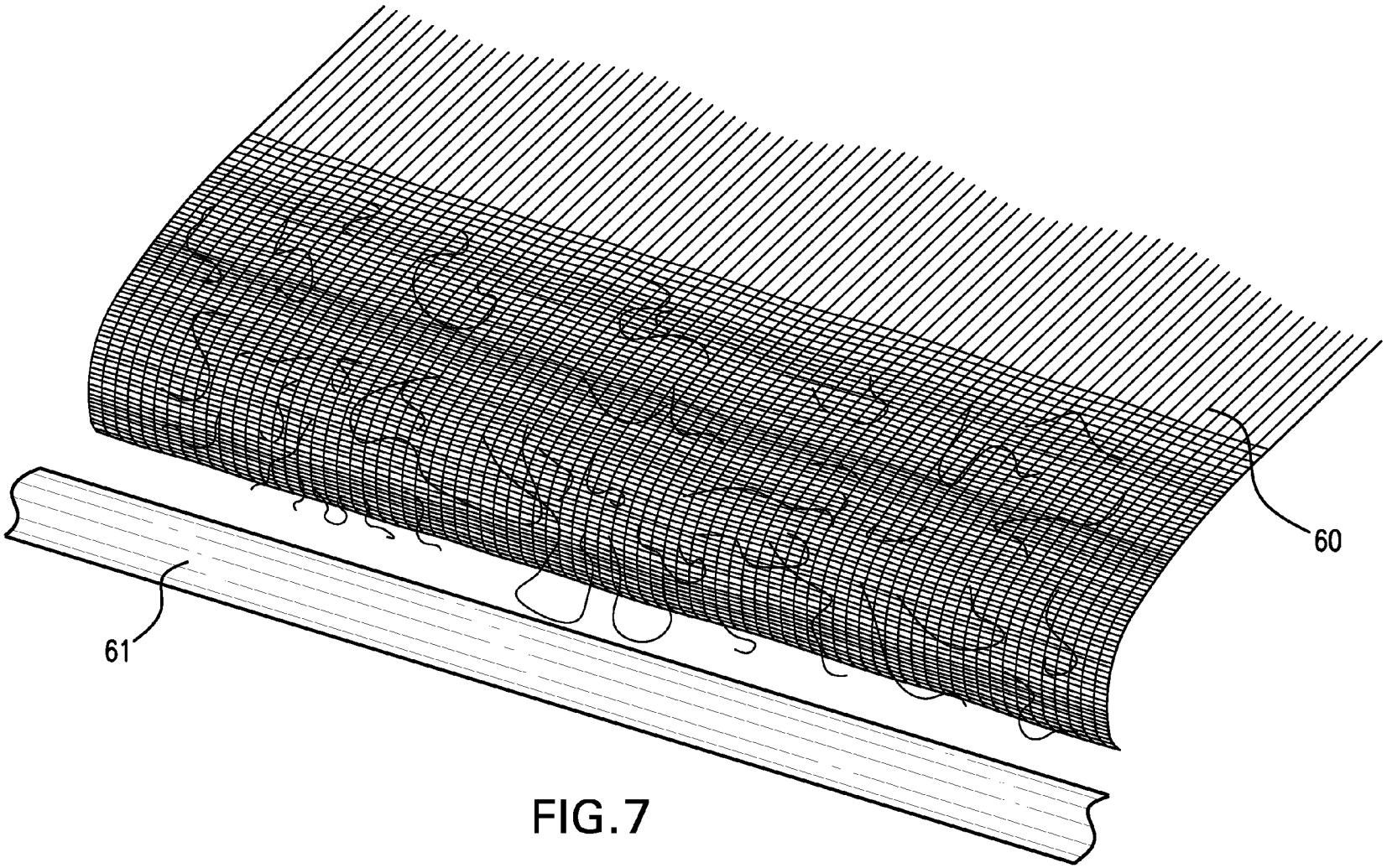
FIG. 7 provides a view similar to that of FIG. 6, but in which the fiber bundles have not been laced according to the present invention.

The present invention has been found effective in preventing the fibers from splaying out in the loom feeder. FIGS. 6 and 7 provide a comparison of the fiber bundles, with and without lacing according to the present invention.

FIG. 6 provides a fragmentary perspective view showing a fabric mat, formed by weaving bundles of fibers on a loom 60. A support member 61 for the loom is also shown, in a fragmentary view. In the example shown in FIG. 6, the fiber bundles have been laced with thread according to the present invention. In the example of FIG. 7, the fiber bundles have not been so laced. It is apparent that there has been much more splaying of fibers in FIG. 7 than in FIG. 6.

The reduction in splaying, achieved by the present invention, reduces the amount of tangling in the loom feeder, and therefore reduces the amount of clogging and possible stoppages of the loom. The reduced amount of tangling improves the appearance and uniformity of the fiber bundle. The reduced number of stoppages of the equipment results in shorter wrap times, and greater efficiency of production of the modules.

Another benefit of the invention is an improvement in the properties of the fiber membrane, especially when the lacer is used with fiber that is difficult to handle. The following Example quantifies this benefit.

EXAMPLE

Three different polymers were used to form fiber membranes. The polymers were selected to be useful in separating oxygen and nitrogen. These polymers were designated as 1, 2, and 3. The fiber bundles made of these materials were tested with either no lacer, a single lacer, or two lacers in series (the latter being what is shown in the figures). That is, these fiber bundles were woven into a fabric mat, and the fabric mat was rolled up and placed in a module housing. The flux of oxygen, and the selectivity between oxygen and nitrogen, were measured and compared. The results are shown in the following table:

| Test Conditions | Oxygen Flux $*10^{-6}$ (scc/sec · $cm^2$ · cm Hg) | $O_2/N_2$ Selectivity |
|---|---|---|
| Fiber 1, no lacer | 22.04 | 4.79 |
| Fiber 1, single lacer | 22.19 | 6.42 |
| Fiber 2, no lacer | 23.95 | 5.64 |
| Fiber 2, two lacers in series | 23.88 | 6.28 |
| Fiber 3, no lacer | 22.10 | 4.64 |
| Fiber 3, two lacers in series | 20.31 | 5.67 |

For all three fiber materials used, the selectivity was significantly improved with the use of the lacer of the present invention.

The present invention can be modified in various ways. The number of spools can be varied. The number of fiber bundles being processed at once can be changed. The invention can be practiced with fibers having varying compositions. These and other modifications, which will be apparent to those skilled in the art, should be considered within the spirit and scope of the following claims.

What is claimed is:

1. Apparatus for automatic lacing of polymeric fiber bundles, comprising:

a) a spool, the spool having an interior portion which is hollowed sufficiently to allow a fiber bundle to pass through the spool, the spool being wound with a thread, b) means for moving a fiber bundle through the interior portion of the spool, wherein the thread is wound on the spool such that, when the thread is affixed to the fiber bundle and pulled, by the fiber bundle, from the spool, the thread becomes spirally wound around the fiber bundle, further comprising a tensioning overwrap disposed on the spool, the overwrap being attached to a weight.

2. The apparatus of claim 1, wherein there are a plurality of fiber bundles, and wherein the fiber bundles pass through an eyelet before passing through the spool.

3. The apparatus of claim 1, wherein there are a plurality of spools, the spools being arranged in series.

4. The apparatus of claim 3, wherein the fiber bundles exiting each spool pass through a small eyelet disposed downstream of each spool.

5. The apparatus of claim 1, further comprising a loom for weaving laced fiber bundles into a fabric mat.

6. Apparatus for automatic lacing of polymeric fiber bundles, comprising:

a) a spool, the spool having an interior portion which is hollowed sufficiently to allow a fiber bundle to pass through the spool, the spool being wound with a thread, b) means for moving a fiber bundle through the spool, wherein the thread is affixed to the fiber bundle, such that the thread is pulled from the spool when the fiber bundle is moved, and such that the thread becomes spirally wound around the fiber bundle as the fiber bundle is moved, further comprising a tensioning overwrap disposed on the spool, the overwrap being attached to a weight.

7. The apparatus of claim 6, wherein there are a plurality of spools, the spools being arranged in series.

8. The apparatus of claim 7, wherein the fiber bundles exiting each spool pass through a small eyelet disposed downstream of each spool.

9. The apparatus of claim 6, further comprising a loom for weaving laced fiber bundles into a fabric mat.

10. A method of automatic lacing of a bundle of polymeric fibers, the method comprising:

a) inserting a fiber bundle through at least one hollow spool, the spool being wound with a thread, b) affixing an end of the thread to the fiber bundle, c) placing a tensioning overwrap on the spool, the overwrap being attached to a weight, and d) moving the fiber bundle through the spool, wherein the thread is pulled from the spool and becomes wound around the fiber bundle, wherein the fiber bundle becomes automatically laced with the thread.

11. The method of claim 10, wherein there are at least two spools, arranged in series, and wherein step (b) is performed separately for each spool.

12. The method of claim 10, wherein step (a) comprises inserting a plurality of fiber bundles through the spool, and wherein the inserting step includes passing the fiber bundles through an eyelet.

13. The method of claim 10, wherein there are at least two spools, arranged in series, and wherein step (b) is performed separately for each spool, the method further comprising tensioning the thread on the spool, so as to provide friction for the thread as it unwinds from the spool.

14. The method of claim 10, further comprising weaving the fiber bundle on a loom, to produce a fabric mat formed of fiber.

15. A method of making a rolled fabric mat made of fibers formed of a polymeric membrane capable of allowing different components of a gas to pass through the membrane at different rates, the method comprising:

a) inserting a bundle of polymeric fibers through a central hollow portion of a spool, the spool being previously wound with a thread, b) attaching the thread to the bundle, c) pulling the bundle through the spool, wherein the thread is unwound from the spool and becomes automatically wound around the bundle, and d) weaving the bundle, on a loom, into a fabric mat, further comprising tensioning the thread on the spool, by placing a tensioning overwrap on the spool, the overwrap being attached to a weight, so as to provide friction for the thread as it unwinds from the spool.

16. The method of claim 15, wherein there are at least two spools, arranged in series, and wherein step (b) is performed separately for each spool.

* * * * *